US005523744A

United States Patent [19]

Wieser

[11] Patent Number: 5,523,744

[45] Date of Patent: Jun. 4, 1996

[54] DEVICE FOR TESTING THE OPERATION OF SMOKE DETECTORS

[75] Inventor: Dieter Wieser, Zürich, Switzerland

[73] Assignee: Cerberus AG, Männedorf, Switzerland

[21] Appl. No.: 318,662

[22] PCT Filed: Jan. 21, 1994

[86] PCT No.: PCT/CH94/00010

§ 371 Date: Oct. 11, 1994

§ 102(e) Date: Oct. 11, 1994

[87] PCT Pub. No.: WO94/18653

PCT Pub. Date: Aug. 18, 1994

[30] Foreign Application Priority Data

Feb. 15, 1993 [CH] Switzerland ..... 455/93-3

[51] Int. Cl.[6] ..... G08B 17/10

[52] U.S. Cl. ..... 340/630; 340/628; 250/574

[58] Field of Search ..... 340/628, 629, 340/630, 632, 633, 634, 606, 514, 515, 516, 517; 250/573, 574, 576, 576, 577; 73/1 G

[56] References Cited

U.S. PATENT DOCUMENTS

| | | | |
|---|---|---|---|
| 2,627,064 | 1/1953 | Allen | 340/515 |
| 3,585,621 | 6/1971 | Di Cello et al. | 340/515 |
| 3,693,401 | 9/1972 | Purt et al. | 73/1 R |
| 4,053,785 | 10/1977 | Lee et al. | 250/574 |
| 4,271,693 | 6/1981 | Bute | 73/1 G |
| 4,374,329 | 2/1983 | Schoenfelder et al. | 250/574 |
| 4,555,634 | 11/1985 | Muggli et al. | 250/565 |
| 4,647,785 | 3/1987 | Morita | 250/574 |
| 4,827,244 | 5/1989 | Bellavia et al. | 340/514 |

FOREIGN PATENT DOCUMENTS 1079929 8/1967 United Kingdom .

OTHER PUBLICATIONS

JP–A–53–99899: Abstract in English.

*Primary Examiner*—Brent A. Swarthout
*Assistant Examiner*—Benjamin C. Lee
*Attorney, Agent, or Firm*—Burns, Doane, Swecker & Mathis

[57] ABSTRACT

A device (7) for testing the operation of smoke detectors (3) has a housing (1) which is open at one end and can be placed over the smoke detector (3). A test light source (5) in the housing provides light pulses which radiate into the inside of the smoke detector (3) under test. The test device also has a test light detector (4) that receives light coming from the smoke-indicating light source (15) of the smoke detector (3) and controls the test light source (5) in relation to the received light. The light pulse of the test light source (5) is received by the smoke-indicating light detector (14) of the smoke detector (3). By checking if the smoke detector (3) goes into the alarm state, it can be ascertained whether it is in an operational condition.

12 Claims, 1 Drawing Sheet

DEVICE FOR TESTING THE OPERATION OF SMOKE DETECTORS

The invention concerns a device for testing the operation of smoke detectors of a type used in fire alarm systems for the early detection of fires. Such detectors serve to detect smoke particles or aerosols appearing during a fire, and if necessary to send a signal to a central process unit where the signals are evaluated.

BACKGROUND

Examples of smoke detectors for the early detection of fires are ionization smoke detectors in which the change in conductivity of ionized air is utilized to indicate fire aerosols, and optical smoke detectors in which the absorption or scattering of light by smoke particles is used. Since in ionization smoke detectors radio activity - albeit low-level is present, optical smoke detectors are increasingly used, especially scattered-light detectors, since the latter can be of a construction having a small space requirement.

Optical smoke detectors operating on the scattered-light principle contain a radiation source and a radiation detector. The detector is arranged outside the direct radiation area of the radiation source, but, in the presence of smoke or fire aerosol in the radiation area (measuring chamber), the detector is exposed to scattered radiation and generates electrical output signals depending on the strength of the scattered radiation. These signals are evaluated in an electronic circuit present in the smoke detector for alarm generation, or they are passed to the central process unit. In order to avoid interference by outside light, the light sources frequently operate in a pulsed manner, for example see the smoke detector system described in EP-B1-0'079'010.

Fire alarm systems must be ready for operation over long time periods. The smoke detectors are exposed to the harmful effects of the surrounding atmosphere, e.g. dust or corrosive vapors. Furthermore the quality of the electronic components, especially the radiation source and the radiation detector, can be reduced by aging. It is therefore necessary to check the operational capability of the smoke detectors at regular intervals.

In practice, this checking is usually effected by igniting a small test fire underneath the smoke detector, to produce smoke which can enter the detector and make it respond. Testing also has been carried out by placing a burning wick, e.g. on a rod, directly under the detector (for example see U.S. Pat. No. 4,271,693). Apart from the fact that these methods are rather cumbersome, they frequently result in contamination of the detector, which could render it incapable of operation.

An attempt has therefore been made to replace the smoke by droplets of fluid, e.g. artificially-produced mist, since such aerosols affect the smoke detectors in the same way as smoke from fires. For example, a mist of water droplets has been produced and used for the test. The layer of water deposited on the inner surfaces makes the detector inoperative over long periods.

Test agents which have proved most successful are mixtures of halogenated hydrocarbons (propellants) which have a suitable boiling point and which are blown directly into the smoke detectors from suitable storage containers arranged in so-called detector testers (for example see DE-B2-20'54'027). Due to the pressure-loss during discharge a suitable quantity of aerosol is produced for testing the smoke detector. Due to the high vapor pressure of the halogenated hydrocarbons, the propellant evaporates within a short time and the operational capability of the detector is not impaired.

A suitable detector tester for the testing of smoke detectors with halogenated hydrocarbons consists of a housing open at one end, which can be placed over the smoke detector, whose volume is at least twice the volume of the smoke detector, and a container connected to the housing that contains the propellant liquified under pressure and which, with the housing in place, has a spray valve operated manually or automatically, whose nozzle leads into the inside of the housing.

Because of the environmentally-harmful properties of halogenated hydrocarbons, these can no longer be used. Materials considered as replacements are mostly inflammable, toxic, corrosive and/or expensive (see Nachr. Chem. Tech. Lab. 40 [1992], No. 12, page 1398).

Other known test methods for fire alarm systems with optical smoke detectors operate without the use of test gases. Generally speaking, in this case also procedures are used which simulate the ingress of smoke into the smoke detectors. Here for example, an additional light source which projects light directly onto the radiation detector can simulate the appearance of scattered light in the smoke detector (U.S. Pat. No. 2,627,064). A test device is described in U.S. Pat. No. 3,585,621, in which a calibration element which projects scattered light onto the light detector and, for example, simulates a smoke concentration of 4%, is used to check the light source. In GB-PS-1,079,929 testing of the optical smoke detector is implemented by simulating an alarm (scattered light) by introducing a vane into the radiation path.

The voltage at the input of the threshold detector can also be increased to a value just under the response voltage by means of a switch (JP-PA-46-12199); the peaks of the diffused stray light, which are normally well below the response threshold, are in this case increased until an alarm is generated during the test. Here it is possible to test the operation of flash lamp, photocell, amplifier and switching circuit simultaneously.

A photo-electric smoke detector for indicating both alarm and fault conditions is disclosed in U.S. Pat. No. 4,306,230, which has a detection device consisting of a light source and a light-sensitive element arranged outside the direct path of the light source, which generates an output signal in relation to an initial change caused by the presence of smoke. In the smoke detector a second detection device is provided, which makes it possible to detect a fault condition (contamination of the surfaces of the light source or light-sensitive element) by allowing a predetermined amount of light to fall through an opening in the housing of the detector onto the light-sensitive element. If the amount of light falling through the opening does not trigger a signal within a specific range, then a detector fault is indicated.

A method for testing photo-electric smoke detectors is described in EP-A1-0'122'5489, in which, in addition to the smoke-indicating light source and the smoke-indicating light detector, a test light detector which receives light directly from the light source, and a test light source which radiates light directly onto the smoke-indicating light detector in relation to the output signal of the test light detector, are provided in the measuring chamber of the scattered-light smoke detector. In this method the operation of the smoke detector is continuously monitored by a control center; the detector is tested to ascertain if it is operating correctly and if its sensitivity is within the normal range.

The disadvantage of all these test methods is that means for testing the detector have to be provided in each individual smoke detector, which makes the fire alarm system considerably more expensive.

A device for testing the operation of optical smoke detectors is described in JP-PA-53-99899, in which a part of the housing that shields the measuring chamber against the external atmosphere, is comprised of rubber or an elastic body, e.g. a sponge. The elastic body is covered by a flat plate which has an opening in the center. For testing, a device consisting of four arms that are placed over the detector, is used. In the center of the four arms is a needle that passes through the rubber into the measuring chamber of the detector and simulates the appearance of scattered light in the chamber. This means that additional structure must be provided on or in the detectors, to facilitate the function test.

SUMMARY OF THE INVENTION

Based on this state-of-the-art, the aim of an invention is to provide smoke detector apparatus which avoids the disadvantages of known devices for testing the operation of smoke detectors. In at least some embodiments, the invention makes it possible to test their detectors at the installation site without having to use means which can damage the detectors or the environment. A further aim of the invention is to be able to test the detectors without having to install additional structure on or in the individual detectors.

A method according to the invention for testing the operation of smoke detectors, particularly scattered-light smoke detectors, is based on the fact that a scattered-light smoke detector is shielded by the detector housing to a great extent from light from the environment entering the detector, and that the shielding, however, is not absolute since the detectors must be open to the outside atmosphere to enable smoke to enter the measuring chamber. Due to scattering of the light at components inside the detector, light from the light source inside the detector housing can pass through to the outside and conversely, light from outside can be radiated to the inside of the detector housing and reach the light detector by scattering.

According to a preferred embodiment of the device according to the invention, the housing of the test apparatus carries a test light detector that can receive the light that comes from the inside of the smoke detectors by scattering. The output signal of this tester light sensor controls a test light source in the test apparatus so that this radiates to the inside of the smoke detector under test a light pulse which corresponds to the light pulse radiated from the smoke-indicating light source inside the smoke detector.

In accordance with a further preferred embodiment of the device according to the invention, at its upper edge the housing has means distributed over the periphery, that are constructed so that when the detector tester is placed over a smoke detector under test, they ensure that the detector tester always has the same alignment with respect to the smoke-indicating light detector of the smoke detector. This ensures that the same test conditions apply during the testing of different smoke detectors. Preferably, the means for aligning the detector tester consist of projections and guide slots, the latter making contact with a guide lug provided on the smoke detector. This guide lug does not need to be additionally provided for testing purposes since it must be present anyway for the correct insertion of the detector into the base (electrical contacts; alignment of the alarm indicator).

For better handling of the detector tester, at the closed end of the housing is an extension which can be axially plugged onto an extensible rod, that is preferably hollow, to be able to test smoke detectors that are fitted to ceilings in tall rooms.

In accordance with a form of the device according to the invention, additional means can be provided in or on the housing for testing ionization smoke detectors. An air-stream can be blown into an ionization smoke detector under test by way of such means. Further means, with which the air-stream can be optionally heated, are provided in order that thermal detectors can also be tested with this preferred embodiment of the device according to the invention.

In another form of the device according to the invention, means are provided in the evaluation electronics, which enable the smoke-indicating light source in the smoke detector to be tested for ageing, contamination or defect by means of a quantitative or threshold measurement of the light output which falls onto the test light detector.

In accordance with another feature of a further preferred form of the invention, a test light source in the tester emits a pulse when the test light detector in the tester senses a light pulse from the light source inside the smoke detector and is then blocked from emitting onto the test light detector, from re-triggering a light pulse from the test light source. It is possible, for example, to block the electrical signal of the test light detector until a further light pulse leaves the smoke-indicating light source.

BRIEF DESCRIPTION OF THE DRAWINGS

The invention is explained in more detail below with the aid of the embodiments illustrated in the drawings, of which.

DETAILED DESCRIPTION OF PREFERRED EMBODIMENTS

Where the drawings are described below, it is understood that the representation has been simplified to the extent that only so much of the construction of the test device for a photo-electric smoke detector is shown as is necessary for person skilled in the art to easily understand the underlying principles and terms. Throughout this description and in the claims, only "light", "light" sources and "light"-sensitive elements ("light" detectors) are discussed. However, it is clear that the term "light" is also understood to mean invisible light such as infra-red radiation or ultraviolet light, i.e. basically any electromagnetic radiation that is usually employed in optical smoke detectors. With reference to the figures, devices according to the invention are described in the form of examples and not limitations.

Figure 1:
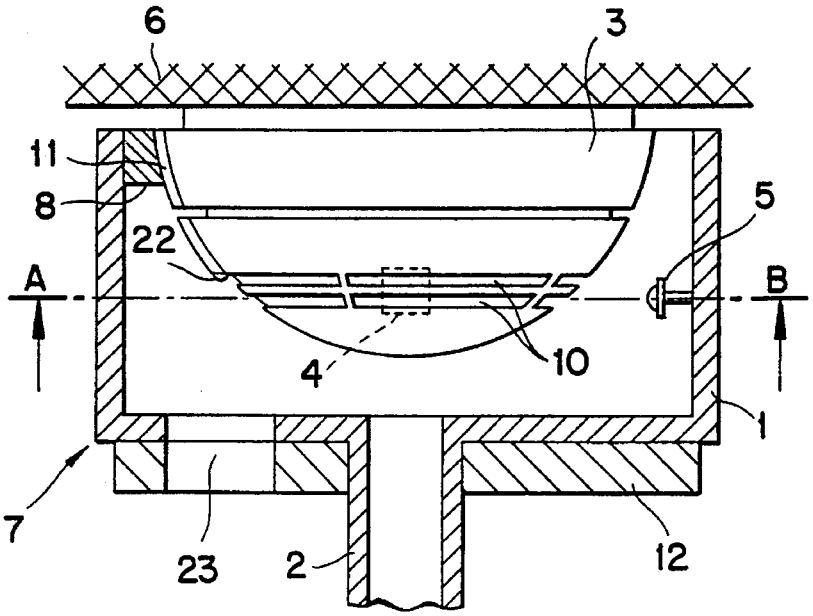
FIG. 1 shows a longitudinal section through a device for testing the operation of smoke detectors according to this invention and FIG. 2 shows a cross-section through a device for testing the operation of smoke detectors, along the line A—B in FIG. 1.

FIG. 1 shows an embodiment of a device (detector tester) 7 according to the invention for testing the operation of smoke detectors. The detector tester 7 is shown in an axial longitudinal section in the operating position when placed over the housing of a smoke detector 3 (shown in the side view) installed in the ceiling 6 of a room. The detector tester 7 consists of a rotationally-symmetric, cylindrical tester housing 1 that has a spigot-shaped extension 2 underneath, onto which a rod can be plugged to enable detectors 3 that are fitted in high ceilings 6 of rooms to be tested.

A test light source 5 is mounted at the inner wall of the housing 1. At the upper edge of the housing 1 are several projections 8 distributed around the periphery of the edge, in which guide slots 9 are provided. When the detector tester 7 is placed over a smoke detector 3 under test, the slot 9 in conjunction with a guide lug 11 placed on the smoke detector 3, ensure that the test light source 5 in the detector tester 7 is always in the same position relative to the smoke-indicating light sensor or detector 14 of the smoke detector 3, so that the same conditions always apply during the testing of different smoke detectors 3.

The housing 1 can be manufactured from any material; usefully, for weight-saving reasons, it is made from a suitable plastic or light metal. The electronics 12 of the detector tester 7, e.g. the necessary batteries and such like for operating the test light source 5, are located in a separate compartment on the underside of the housing 1. The underside of the housing 1 and the electronics compartment 12 have an opening 23 through which the alarm indicator 22 of the smoke detector 3 can be observed.

To test a smoke detector 3, the detector tester 7 is placed over the smoke detector 3 so that the guide slots 9 slide over the guide lugs 11 on the smoke detector 3 and the projections 8 of the detector tester 7 make contact with the housing 1 of the smoke detector 3. By putting the test light source 5 into operation, a pulsed light beam is transmitted to the inside of the housing of the detector 3 and by observing the alarm indicator 22 on the smoke detector 3 or in the signal control center (not shown) it can be ascertained whether the smoke detector 3 is operative.

In accordance with a preferred embodiment of a detector tester 7 according to the invention, FIG. 1 shows a test light detector 4 (shown dotted in FIG. 1) mounted on the inner wall of the tester housing 1. Otherwise this embodiment corresponds to the detector tester 7 as described above.

Figure 2:
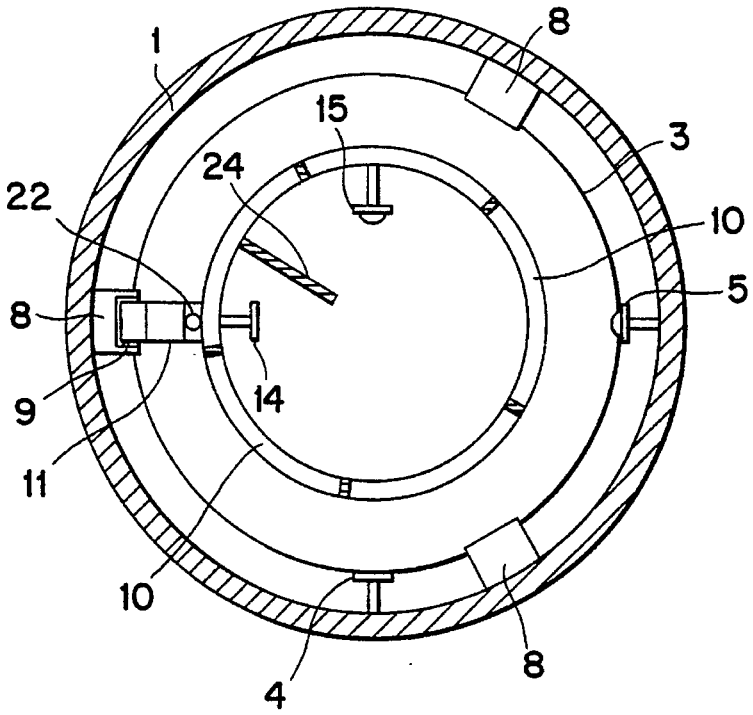

A horizontal section through this preferred embodiment of the detector tester 7, along the line A—B in FIG. 1, is shown in FIG. 2. As in FIG. 1, it is shown in the operating position when placed over a smoke detector 3 mounted on the ceiling 6 of a room. Inside the housing of the smoke detector 3 are shown only the smoke-indicating light source 15, the smoke-indicating light detector 14 and means that, in this diagram are indicated by light shield plates 24, which prevent light falling directly from the smoke-indicating light source 15 onto the smoke-indicating light detector 14 of the smoke detector 3. Apart from the test light source 5, a test light detector 4 (shown dotted in FIG. 1) is mounted on the inner wall of the housing 1.

Externally, the housing 1 is located with the three projections 8 and the guide slots 9, which are used in conjunction with the guide lugs 11 on the smoke detector 3 to align the detector tester 7 with respect to the smoke detector 3. The result of this is that, when placed over a smoke detector 3 under test, the test light source 5 of the detector tester 7 and the smoke-indicating light detector 14, and the test light detector 4 and the smoke-indicating light source 15 of the smoke detector 3, are always in the same positions with respect to each other, so that identical test conditions always apply during the testing of different smoke detectors 3.

The electronics 12 include an amplifier/bandpass filter (not shown) for amplifying, filtering and evaluating the electrical signal output by the test light detector 4, as well as electronic means for driving the test light source 5.

During the test process, due to scattering at components of the scattered-light smoke detector 3, the pulsed light of the smoke-indicating light source 15 passes out of the detector and falls on the test light detector 4 of the detector tester 7. Depending on the incident light, the test light detector 4 outputs an electrical signal that is amplified in the amplifier/bandpass filter. The electronics 12 contains means for comparing the amplitude of this signal with a predetermined threshold value. If the output signal of the amplifier exceeds this threshold value, the test light source 5 is triggered and outputs a light pulse that time-wise, partially overlaps those of the smoke-indicating light source 15 of the scatter-light smoke detector 3. Due to scattering at components of the smoke detector 3, this light pulse reaches the inside of the detector and falls onto the smoke-indicating light detector 14. After receiving such a pulse once or several times, an alarm signal is triggered in the smoke detector 3. The operational capability of the scattered-light smoke detector 3 can thus be recognised at the alarm indicator 22 (or in the signal control center).

Furthermore, the electronics 12 contains switching elements which prevent light from the test light source 5, that falls onto the test light detector 4, from causing re-triggering of the test light source 5. This can be achieved, for example, by blocking the output signal of the test light detector 4 for a time interval following the first triggering of the test light source 5, that is shorter than the time interval between two light pulses of the smoke-indicating light source 15 of the smoke detector 3.

In accordance with a further form of the detector tester 7 according to the invention, means can be provided in the housing 1, which make it possible to remove a smoke detector 3 from its holder and replace it. This dispenses with the use of a special device (detector extractor) for removing and fitting detectors.

In order to be able to test other smoke detectors that are not based on the scattered light principle, a fan can be mounted in the hollow extension 2 of the detector tester 7. The fan blows an air-stream into the housing 1 that is sufficiently strong to set an ionization smoke detector into the alarm state. If a heating coil is placed in front of the blower, then the detector tester 7 can also be used for testing thermal detectors.

Within the scope of the invention, variations of the device for testing the operation of smoke detectors as described above are possible according to the claims and are familiar to the expert.

What is claimed is:

1. Device for testing the operation of optical smoke detectors of a type having a light source and a smoke-indicating light detector, comprising a housing open at one end and substantially closed at another end to be placed over and substantially enclose a smoke detector, in which means are provided to simulate the occurrence of fire parameters inside the smoke detector, said means comprising a test light source arranged inside the housing so that light transmitted from the test light source can be received by the smoke-indicating light detector of the smoke detector.

2. Device according to claim 1, further comprising a test light detector arranged in the housing to receive light transmitted by said light source of the smoke detector to trigger said test light source through an output signal.

3. Device according to claim 2, wherein means are provided to prevent light emitted by the test light source from re-triggering said test light source when said light emitted by the test light source falls onto said test light detector.

4. Device according to claim 3, wherein said means that prevent light emitted by the test light source from retriggering comprises switching elements that block the signal coming from the test light detector for a predetermined time period following said triggering of said test light source.

5. Device according to claim 1 for testing the operation of optical smoke detectors of said type further provided with guide means on the detector peripherals, said device further comprising means provided at the upper edge of said housing and distributed over the housing peripheral and being constructed so that when placed over a smoke detector under test, conjunction of said distributed means with guide means provided on the smoke detector (3) aligns the detector tester with the smoke detector so that the test light source of the detector tester and the smoke-indicating light detector, and the test light detector and the light source of the smoke detector, respectively, are in predetermined positions with respect to each other so that identical test conditions apply during subsequent testing of the smoke detector.

6. Device according to claim 5, wherein said means distributed over the housing peripheral includes projections and guide slots, and said guide means comprise a guide lug, said guide slots making contact with said guide lug provided on the smoke detector.

7. Device according to claim 1, including means provided in or on the housing to enable said device to also test smoke detectors of the ionization type; said means provided in or on the housing being operated to blow an air-stream into an ionization smoke detector under test.

8. Device according to claim 7, wherein means are provided to heat said air-stream.

9. Device according to claim 1, wherein, at the closed end of the housing, an axial extension is formed, onto which a rod can be plugged.

10. Apparatus for testing in situ the operability of smoke detectors of the scattered light type mounted on structural surfaces such as ceilings, said detectors being of a type wherein a light source and a light sensor are positioned within a detector housing so that light from the light source does not illuminate the sensor directly but is capable of illuminating smoke particles which may scatter light to the sensor to produce an alarm signal; said testing apparatus including a tester housing having an open end and a substantially closed other end to be placed over a smoke detector under test to substantially enclose said smoke detector, and a test light source in said tester housing for emitting light such that some of said tester emitted light reaches said sensor in the detector housing to cause said sensor in the detector housing to produce an alarm signal if said smoke detector is in an operating state.

11. Apparatus according to claim 10, wherein said testing apparatus additionally includes a tester light sensor in said tester housing for receiving light emitted from said detector housing upon illumination of said light source in said detector housing, and means for triggering illumination of said test light source in said tester housing upon detection by said tester light sensor of light from said light source in said detector housing so that said sensor in said detector housing will not be caused to produce an alarm signal unless said light source in said detector housing is in an operating state.

12. Method for testing the operation of optical smoke detectors of the type having a smoke-indicating scattered light detector and a light source, comprising the steps of: providing a test device that comprises a housing open at one end and substantially closed at another end to be placed over and substantially enclose a smoke detector under test, said test device having a test light detector and a test light source, and means connecting said test light detector to said test light source; producing an output signal by said test light detector upon receiving incident light coming from the light source of said smoke detector under test; and radiating a light signal by said test light source corresponding or proportional to said output signal into said smoke detector in response to said test light detector output signal, to test the operability of said smoke detector.

* * * * *